United States Patent [19]

Proud et al.

[11] 4,427,925

[45] Jan. 24, 1984

[54] ELECTROMAGNETIC DISCHARGE APPARATUS

[75] Inventors: Joseph M. Proud, Wellesley Hills; Robert K. Smith, Wilmington; Charles N. Fallier, Jr., Westford, all of Mass.

[73] Assignee: GTE Laboratories Incorporated, Waltham, Mass.

[21] Appl. No.: 322,491

[22] Filed: Nov. 18, 1981

[51] Int. Cl.[3] ..... H05B 41/16; H05B 41/24

[52] U.S. Cl. ..... 315/248; 313/490; 315/39

[58] Field of Search ..... 315/248, 39; 313/447, 313/450, 490

[56] References Cited

U.S. PATENT DOCUMENTS 4,266,162 5/1981 McNeill et al. ..... 315/248

4,266,166 5/1981 Proud et al. ..... 315/248

FOREIGN PATENT DOCUMENTS 399010 3/1966 Switzerland ..... 315/248

*Primary Examiner*—Saxfield Chatmon, Jr.

*Attorney, Agent, or Firm*—David M. Keay

[57] ABSTRACT

An electromagnetic discharge apparatus including an electrodeless lamp containing a fill material which emits light when subjected to a high frequency electric field. The lamp envelope is generally cylindrical. Power is coupled to the contents of the lamp by electrodes which encircle each end of the envelope and are spaced apart in the central region of the envelope to provide a capacitive gap between them. An inner coaxial conductor is connected to one of the electrodes and an outer conductor is connected to the other electrode by way of a conductive shielding member which encircles the lamp and the electrodes. A heating arrangement may be provided to maintain the temperature and thus the pressure of the fill material within the envelope constant.

5 Claims, 1 Drawing Figure

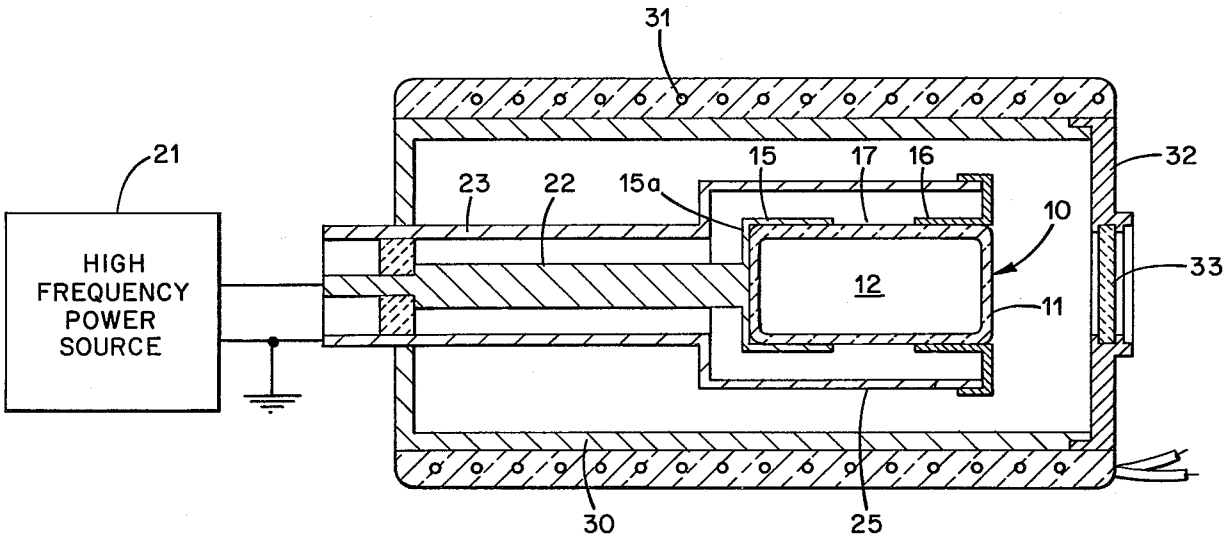
HIGH FREQUENCY POWER SOURCE
21
23
22
15a
31
15
17
16
12
10
11
32
33
25
30

ELECTROMAGNETIC DISCHARGE APPARATUS

BACKGROUND OF THE INVENTION

This invention relates to electromagnetic discharge apparatus. More particularly, it is concerned with electrodeless lamps.

Electrodeless light sources which operate by coupling high frequency power to an arc discharge in an electrodeless lamp have been developed. These light sources typically include a high frequency power source connected to a coupling fixture with an inner conductor and an outer conductor disposed around the inner conductor. The electrodeless lamp is positioned adjacent to the end of the inner conductor. High frequency power is coupled to a light emitting electromagnetic discharge within the electrodeless lamp. A portion of the coupling fixture passes radiation at the wavelengths of the light produced, thus permitting the use of the apparatus as a light source.

SUMMARY OF THE INVENTION

It is an object of the present invention to provide an improved electromagnetic discharge apparatus.

It is another object of the invention to provide an improved electromagnetic discharge apparatus which employs an electrodeless lamp as a source of light.

An improved electromagnetic discharge apparatus in accordance with the present invention comprises an electrodeless lamp having an envelope of a light transmitting substance. The envelope contains a fill material which is capable of emitting light upon breakdown and excitation when subjected to a high frequency electric field. A first electrode of conductive material encircles the envelope adjacent to one end thereof, and a second electrode of conductive material encircles the envelope adjacent to the opposite end thereof. The first and second electrodes are spaced apart in the region between the ends of the envelope to provide a capacitive gap between them. Potential differences at high frequency are produced between the two electrodes by power supply and transmission means. When high frequency energy is coupled across the capacitive gap between the first and second electrodes, the fill material adjacent to the region is subjected to high frequency energy causing breakdown and excitation of the fill material within the envelope.

BRIEF DESCRIPTION OF THE DRAWINGS

The single FIGURE in the drawing is a cross-sectional view in elevation of electromagnetic discharge apparatus in accordance with the present invention.

For a better understanding of the present invention, together with other and further objects, advantages, and capabilities thereof, reference is made to the following discussion and appended claims in connection with the above-described drawing.

DETAILED DESCRIPTION OF THE INVENTION

Electromagnetic discharge apparatus in accordance with the present invention as illustrated in the figure includes an electrodeless lamp 10 having a sealed envelope 11 made of a suitable material which is transparent to the wavelengths of light produced by the lamp. The fill material 12 within the lamp envelope may be any of various materials which break down and are excited by the application of high frequency power to produce light. In the specific embodiment under discussion the lamp envelope 11 is of generally cylindrical configuration having its principal axis disposed horizontally as viewed in the figure. As a specific example, the envelope 11 is 2 cm in diameter and 4 cm in length.

High frequency power is coupled to the fill material within the lamp 10 by a coupling fixture including a first electrode 15 and a second electrode 16. The first electrode 15 is a generally cup-shaped electrode of conductive material which closely encircles the envelope adjacent to one end. The bottom of base portion 15*a* of the cup lies closely adjacent to one end of the lamp and is disposed transversely to the axis of the lamp. The second electrode 16 includes an annular ring portion of conductive material which closely encircles the envelope at the other end. The second electrode 16 does not interfere with the passage of light through the end wall of the envelope. The edges of the two electrodes are separated by a gap 17 in the central region of the lamp between the ends of the envelope. The spacing 17 forms a capacitive gap between the two electrodes 15 and 16. The purpose of the capacitive gap 17 is to provide a concentration of the electric field which initiates the discharge in the fill material. Upon initiation of discharge and thereafter the relatively large areas encompassed by the two electrodes 15 and 16 provide capacitive coupling through the envelope to the discharge.

High frequency power is supplied to the electrodes 15 and 16 of the coupling fixture from a high frequency power source 21 by a transmission arrangement including coaxial conductors 22 and 23. The inner conductor 22 is coupled directly to the high frequency power source 21 and the outer conductor 23 is grounded. The inner conductor 22 which lies along the axis of the envelope 11 is connected to the central region of the base portion 15*a* of the first electrode 15. The outer conductor 23 is connected to the second electrode 16 by a cylindrical member 25 of conductive material which encircles both the lamp 10 and the conductive electrodes 15 and 16. The member 25 thus serves as a grounded shielding member for these elements. The shielding member 25 is fixedly mounted to the outer conductor 23 adjacent to the first electrode 15 and the one end of the lamp. Preferably, as illustrated in the figure, the conductors 22 and 23 may be fixedly mounted in the end wall of an enclosure 30 so as to support the electrodes 15 and 16, shielding member 25, and lamp 10 in position as shown. As can be seen from the figure, the structure supporting the electrodeless lamp 10 and coupling power to it also provides a complete light shield for the lamp except at the one end wall.

The high frequency power source 21 may provide a continuous radio frequency from among those allocated for industrial, scientific, or medical usage located at 13.56, 27.13, 40.68, 915, or 2450 MHz. For certain situations the high frequency power source 21 desirably may be a source of pulses; particularly high voltage pulses in the range of from 1 to 20 kV. These pulses are of narrow width, for example from 1 to 10 nanoseconds, and are produced at a pulse repetion rate of 1 to $10^3$ per second, thus yielding a duty factor of less than $10^{-5}$. Thus even when the pulse power is $10^5$ watts, the average power adsorbed is less than 1 watt.

Under these operating conditions the amount of heat produced is such that there is very little heating of the electrodeless lamp. Under such circumstances the enclosure 30 may be encircled by electric heating coils 31 in order to maintain the chamber within the enclosure at a predetermined temperature independently of the pulsed excitation condition. The front of the enclosure 30 is closed by a removable closure member 32 having a window 33 which is transparent to the light emitted by the lamp 10. The temperature within the enclosure 30 may thus be controlled maintaining the desired pressure of the fill material within the lamp. For example, Table I lists temperatures which are required in order to produce vapor pressures at 1 torr and at 100 torr for a number of representative fill materials which may be employed as sources of light of various wavelengths.

TABLE I

Temperature Required to Provide a Given Vapor Pressure for Several Fill Materials

| Fill Material | 1 torr | 100 torr |
|---|---|---|
| Hg | 126° C. | 262° C. |
| Cd | 394° C. | 611° C. |
| $I_2$ | 39° C. | 116° C. |
| $HgCl_2$ | 136° C. | 237° C. |
| $HgBl_2$ | 137° C. | 238° C. |
| $HgI_2$ | 157° C. | 261° C. |

The fill material 12 may be any of various materials such as those listed by way of example in Table I. The configuration of the apparatus as shown permits the easy removal of the electrodeless lamp 10 and the substitution of another one containing any desired fill material. Thus the apparatus as shown is particularly suitable as a test apparatus for determining characteristics of various fill materials under various temperature and pressure conditions.

While there has been shown and described what is considered a preferred embodiment of the present invention, it will be obvious to those skilled in the art that various changes and modifications may be made therein without departing from the invention as defined by the appended claims.

What is claimed is:

1. Electromagnetic discharge apparatus comprising an electrodeless lamp having an envelope of a light transmitting substance;

a fill material within the envelope capable of emitting light upon breakdown and excitation when subjected to a high frequency electric field;

a first electrode of conductive material encircling said envelope adjacent to one end thereof;

a second electrode of conductive material encircling said envelope adjacent to the opposite end thereof;

said first and second electrodes being spaced apart in the region between the ends of the envelope to provide a capacitive gap therebetween; and power supply and transmission means for producing potential differences at high frequency between said first and second electrodes whereby high frequency energy is coupled across said capacitive gap between said first and second electrodes subjecting the fill material adjacent to said region to high frequency energy causing breakdown and excitation of the fill material within the envelope; wherein the envelope of said electrodeless lamp is generally cylindrical having an end wall at said one end and an end wall at said opposite end;

said first electrode closely encircles a first portion of the cylindrical envelope adjacent to said one end;

said second electrode closely encircles a second portion of the cylindrical envelope adjacent to said opposite end and permits the passage of light emitted by the fill material within the envelope through the end wall at said opposite end of the envelope; and said first and second electrodes have first and second edges, respectively, spaced from and opposed to each other to provide said capacitive gap therebetween.

2. Electromagnetic discharge apparatus in accordance with claim 1 wherein said power supply and transmission means includes coaxial conduction means comprising an inner conductor connected to said first electrode and an outer conductor coupled to said second electrode.

3. Electromagnetic discharge apparatus in accordance with claim 2 wherein said first electrode is generally cup-shaped having a portion lying closely adjacent to the end wall of said one end of said envelope;

the inner conductor of the coaxial conduction means is connected to the central region of said portion of the first electrode;

said second electrode includes an annular ring portion closely encircling said second portion of the cylindrical envelope adjacent to said opposite end without interfering with the passage of light emitted by the fill material within the envelope through the end wall at said opposite end of the envelope;

and including a conductive shielding member encircling the envelope and the first and second electrodes, said shielding member being connected to said outer conductor adjacent to said one end of the envelope and being connected to the second electrode adjacent to said opposite end of the envelope.

4. Electromagnetic discharge apparatus in accordance with claim 3 wherein said power supply and transmission means includes a source of electrical pulses of from 1 to 10 nanoseconds in width, at a rate of from 1 to $10^3$ pulses per second, and at a voltage of from 1 to 20 kilovolts connected to the inner conductor; the outer conductor being connected to ground.

5. Electromagnetic discharge apparatus in accordance with claim 3 further including an enclosure having a chamber for containing said electrodeless lamp, said first and second electrodes and said conductive shielding member; and means for maintaining the temperature of the chamber within the enclosure at a substantially constant temperature during operation of the electrodeless lamp;

the portion of the enclosure adjacent to the end wall at said opposite end of the envelope of the electrodeless lamp being transparent to permit the passage of light from the electrodeless lamp therethrough.

* * * * *